United States Patent [19]

Amero

[11] 4,190,194

[45] Feb. 26, 1980

[54] SOLIDS LIQUID SEPARATING CENTRIFUGE WITH SOLIDS CLASSIFICATION

[75] Inventor: Clifford L. Amero, East Walpole, Mass.

[73] Assignee: Bird Machine Company, Inc., South Walpole, Mass.

[21] Appl. No.: 928,995

[22] Filed: Jul. 28, 1978

[51] Int. Cl.[2] ..... B04B 1/20

[52] U.S. Cl. ..... 233/7; 233/47 R

[58] Field of Search ..... 233/7, 1 D, 14 R, 46, 233/47 R

[56] References Cited

U.S. PATENT DOCUMENTS

| | | | |
|---|---|---|---|
| 2,528,974 | 11/1950 | Ritsch | 233/7 |
| 2,766,930 | 10/1956 | Schmiedel | 233/7 |
| 3,599,861 | 8/1971 | DeMartini | 233/7 |
| 3,854,658 | 12/1974 | Probstmeyer | 233/7 |
| 3,858,794 | 1/1975 | Nilson et al. | 233/7 |

*Primary Examiner*—George H. Krizmanich
*Attorney, Agent, or Firm*—Edgar H. Kent

[57] ABSTRACT

A solids-liquid separating centrifuge of the type having a bowl, a conveyor and drive gearing for rotating the bowl and conveyor at differential speeds, so that the conveyor continuously moves settled solids longitudinally of the bowl to discharge from an outlet in a reduced diameter end of the bowl, has one or more nozzle outlets through the bowl wall with their inlets exposed to the path of movement of a portion of settled solids by the conveyor toward the bowl end solids outlet to remove therethrough a relatively slow settling and difficult to convey portion of the solids.

9 Claims, 4 Drawing Figures

SOLIDS LIQUID SEPARATING CENTRIFUGE WITH SOLIDS CLASSIFICATION

BACKGROUND OF THE INVENTION

This invention relates to solids-liquid separating centrifuges of the continuous type in which a bowl and a helically bladed conveyor are rotated about a common axis in the same direction but at a differential speed to discharge a solids fraction continuously through a reduced diameter outlet, usually a conical end of the bowl. More particularly, the invention concerns the provision of such centrifuges with means enabling the effective separation thereby of the solids of a liquid slurry thereof into two or more separate output fractions of generally different characteristics.

Slurries treated in such centrifuges frequently contain solid particles which vary over a large range in size and other characteristics. In many cases, a fraction of these particles has characteristics which are undesired in the solids recovery sought, such as the generally finer and lighter particle fraction in some slurries, known as "slimes". Slimes not only foul the desired separated solids output, but also interfere seriously with the separation operation itself, since slimes are difficult to convey properly even if kept suspended in slurry liquid up to the reduced diameter point of discharge. Such suspension generally results in a solids cake output wetter than desired, and yet, if it is not maintained, serious consequences may follow, such as choking of the centrifuge and/or fouling of the effluent fraction. Throughput of the machine is curtailed well below capacity.

Operation difficulties with centrifuges of the type concerned, occasioned by slimes in the slurry, have led to the alternative use of centrifuges of the so-called "nozzle" type, wherein all the solids are discharged through nozzles in a solid bowl. But nozzle type centrifuges have other problems such as wet solids cake discharge and plugging of the nozzles by the larger size particles which have to pass through them.

As a compromise, it has been proposed in the prior art, e.g., U.S. Pat. No. 2,766,930, to modify a centrifuge of the conical end discharge type by including nozzles in an area of the bowl adjacent the cylindrical end opposite the discharge end, where settling of the slimes relative to the coarser fraction is greatest, and to reverse the pitch of a portion of the conveyor blade between the nozzles and the conical discharge end, so that this conveyor part conveys away from the discharge end. Thus, all the solids in the area of the bowl containing the nozzles and the oppositely pitched conveyor portions at opposite sides thereof convey to the nozzles, and all of the solids settling in this part of the bowl have to exit through the nozzles, as they do in a conventional nozzle type centrifuge. So far as known, this proposal has not had significant commercial acceptance, probably because, while it may rid the slurry of part of the slimes fraction that would otherwise be discharged from the conical end, it also involves considerable loss of desired solids settling in the nozzle-equipped area, as well as plugging of the nozzles by the larger particles, since all settled particles in the area served by the nozzles must exit through them.

A similar prior art suggestion utilizes what is in effect a conventional nozzle type cylindrical centrifuge as one end of the bowl, and a conical end discharge centrifuge as the other end of the bowl, as in German Pat. No. 917,777, having a similar mode of operation and practical deficiencies. Still another prior art suggestion has been the provision of nozzles at the end of the bowl, opposite the conical end, from which the effluent discharges, having upstanding inlet pipes beyond the conveyor close to the level of discharge of the liquid fraction over the effluent weir (see German Pat. No. 924,020). Such an arrangement is only effective to remove solids which have not settled and would otherwise go out with the effluent.

SUMMARY OF THE INVENTION

Accordingly, an object of the invention is to provide a centrifuge of the type concerned with a more satisfactory means that has been proposed in the prior art for segregating and separately discharging a slimes fraction from the centrifuged slurry.

Another object is to provide, in a centrifuge of the type concerned, means to segregate from the remainder of the slurry solids and separately discharge a solids fraction which is relatively difficult to convey for discharge from the conical end.

The present invention utilizes at least one nozzle in the bowl wall as does U.S. Pat. No. 2,766,930 discussed above but, in contradistinction to the patent, employs a conveyor which coveys the settled solids across, rather than only up to, the inlet of the nozzle or nozzles. Surprisingly, it has been found that conveying across such nozzle inlets does not materially interfere with the escape of the slimes portion through the nozzles. Instead, it effectively prevents most of the remainder of the slurry from discharging through the nozzles and assists in keeping the nozzle inlets clean and open, thus reducing both the discharge of large solids through the nozzles and nozzle plugging therewith, to which the device of the patent is subject. Indeed, it becomes possible to reduce the diameter of the nozzles below that of the maximum solid particle size of the slurry to the generally smaller maximum particle size of the slimes fraction.

Accordingly, the invention provides, in a centrifuge of the type concerned, means for segregating and separately discharging from the bowl a second portion of the slurry solids, additional to the first portion thereof discharged from the usual bowl outlet and having mainly different characteristics from the solids principally contained in the first portion, due to which they are relatively slower settling and more difficult to convey than the solids of the first portion. These means include at least one nozzle outlet through the peripheral wall of a bowl portion between the point of feed of slurry into the bowl and the end of the bowl opposite the end containing the solids outlet and having its inlet exposed to the path of movement of settled solids by the conveyor toward the bowl end solids outlet, so that at least some settled solids of the first portion are conveyed across the nozzle inlet for discharge from the end outlet and slurry containing solids of the second solids portion is ejected by centrifugal force through the nozzle outlet.

In preferred embodiments, there are at least two such nozzle outlets, the centrifuge includes means for feeding the slurry into the bowl intermediate the ends of the conveyor, and at least two of the nozzle inlets are located adjacent the bowl end remote from its end solids outlet. Thus, these nozzle inlets are located where the generally slower settling slimes are likely to be predominant.

In preferred embodiments also the bowl has connecting cylindrical and frusto-conical portions, with the solids outlet at the smaller end of the latter and with an effluent outlet at the end of the cylindrical section remote from the frusto-concial section, the conveyor extends throughout the length of both bowl portions, and the nozzle outlets are located in the cylindrical portion, preferably two, at least, being adjacent the effluent discharge end.

By utilization of the invention, the solids with reduced slimes convey more readily, so that it becomes possible to reduce the pool depth substantially below the level of the end solids outlet, the solids no longer needing hydraulic-assist for conveying to this level. This has not only advantages previously mentioned, but also provides a desirable drainage area for the solids as they are conveyed between the point of emergence from the liquid pool and the point of discharge from the outlet. In addition, with certain solids such for example as coal fines, wash water may be applied to the solids while they are transversing this drainage area, to rid them of adhering slimes and improve the desired characteristics of the solids cake discharged.

DESCRIPTION OF THE PREFERRED EMBODIMENT

Figure 1:
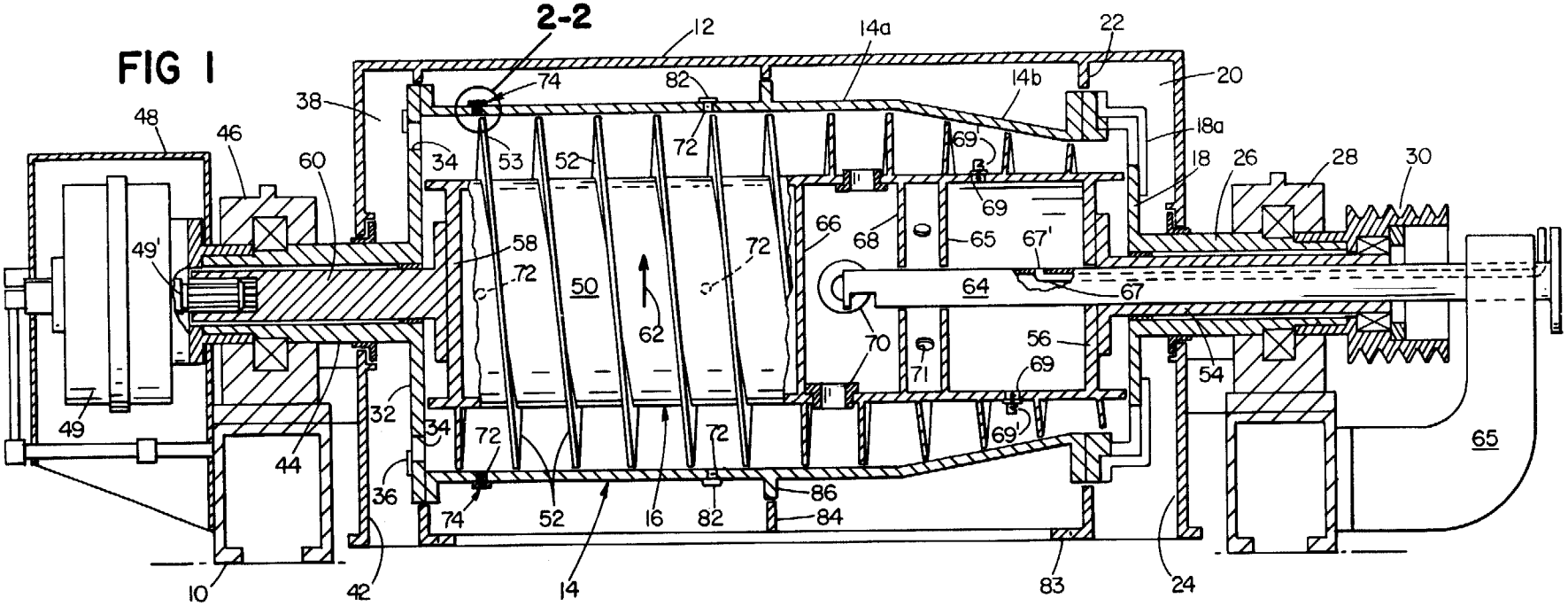
FIG. 1 is a view partly in longitudinal section, partly in side elevation of a centrifuge according to the invention, broken away in part to show interior construction.

The centrifuge shown in FIG. 1 has a base 10 which carries a casing 12 housing the rotary assembly of the solid walled centrifuge bowl, designated generally 14, and the conveyor, designated generally 16. Bowl 14 is made up of a cylindrical section **14*a* and a frusto-conical section 14*b* joined at its larger end to the cylindrical section. A plate 18 has spider arms 18*a* secured to the smaller diameter end of bowl section 14*b*, a solids fraction discharging from said end over its lip into a gutter 20 formed between the adjacent end wall of casing 12 and a baffle 22 in which Section 14*b* of the bowl is rotatable, the gutter discharging through a bottom outlet 24 to a hopper (not shown). A hollow shaft 26 on plate 18 extends through pedestal mounted bearing 28 to a sheave 30** fixed thereto for rotating the bowl by means of pulley belts from a motor (not shown).

The opposite large end of section **14*a* of the bowl has an end plate 32 fastened thereto, the plate having openings 34 provided with adjustable weir plates 36 over which the effluent fraction discharges from the bowl into a channel 38, formed between the adjacent end of casing 12 and a baffle 40 in respect of which the bowl is rotatable, having a bottom outlet 42 for connection to further effluent storage or treatment equipment (not shown). A hollow shaft 44 on plate 32 extends through pedestal mounted bearing 46 into gearing guard 48 where it is connected to the speed change gearing (as shown, connected to rotate the casing 49** of two stage planetary speed reduction gearing (not shown).

Conveyor 16 has a hollow hub 50 provided with a peripheral helical blade 52 extending from the hub into close clearance with the bowl wall from end to end of the bowl and having the usual wear resistant surfacing 53 on its solids-advancing face. Blade 52 is shown as a single flight but may be multiple flights, and is pitched so that its rotation advances settled solids from the large diameter end of the bowl in section **14*a* to and out its smaller end in bowl section 14*b*. A hollow shaft 54 has a flanged end fixed to an end plate 56 of conveyor hub 50 and extends rotatably through bowl shaft 26. The opposite end of conveyor hub 50 has a closure plate 58 fixed thereto carrying a solid shaft 60 which extends rotatably through hollow bowl shaft 44 and has splined connection to the output shaft 49' of the speed change gearing in casing 49. Thus the conveyor 16 is rotated in the same direction but at a smaller differential to the bowl speed, so that the conveyor rotates relative to the bowl in the direction of arrow 62** to convey settled solids from left to right hand ends of the bowl as shown.

A fixed hollow feed pipe 64 connected to a source of slurry (not shown) extends through a support arm 65 and, with clearance, through hollow shaft 54, and discharges into a feed compartment formed between internal walls 66 and 68 of the conveyor hub 50, pipe 64 extending loosely through wall 68. A plurality of outlets 70 (three of four being shown) supply the slurry to the bowl section **14*a* adjacent its juncture with section 14*b*. For uses in which washing of the solids near their point of discharge is feasible as earlier mentioned, a wash water supply compartment may be provided, formed between end plate 56 of conveyor hub 50 and an internal wall 65 of the conveyor hub which loosely surrounds pipe 64. A wash water feed pipe 67, connected to a source (not shown) extends within pipe 64 to an outlet end 67' disposed in an opening in pipe 64 into the wash water supply compartment. Nozzles 69 are provided for discharging wash water to the solids on the bowl wall opposite the nozzles, fastened in threaded openings into the wash water compartment through the conveyor hub and having outlets 69' preferably, as shown, arranged to discharge the water as a jet spray. The space between internal walls 68 and 65 of the conveyor hub forms a splash compartment to receive any feed slurry escaping from the slurry feed compartment between pipe 64 and wall 68 and to discharge it to the bowl through one or more outlets 71**.

In accordance with the present invention, the centrifuge bowl section **14*a*** is provided with one or more nozzle outlets through its peripheral wall. The number of such outlets used is optional, depending on such factors as the relative proportion of fine, light particles or slimes in the slurry and the extent to which their removal is desired. One such outlet provides useful slimes reduction, particularly if spaced from the feed point far enough to provide substantial solids settling in the feed slurry before it reaches the nozzle outlet. In a commercial application, the use of only two such nozzles in opposite parts of the bowl wall with a near maximum spacing from the slurry inlet permitted an increase of about 50% in the output rate of the end output solids portion of a clay slurry, and upgrading of the quality of the effluent portion. Additional nozzles may be provided in the same relative location and/or in locations closer to the feed point, the latter enabling a partial sub-classification of solids exiting through the nozzles, between a slower settling fraction discharging through the nozzles at maximum spacing from the slurry feed point, and a faster settling fraction or fractions discharging through another nozzle or other nozzles.

Accordingly, it is desirable that the centrifuges be adapted for provision of nozzles in various locations in the bowl wall. This may be done by providing threaded apertures 72 in the bowl wall in selected locations, specifically in FIG. 1 in a first location near the left hand effluent discharge end of the cylindrical bowl part, and in a second location closer to the juncture of the cylindrical bowl part with its frusto-conical part, respectively, four such openings at 90° spacing about the bowl axis being provided in each location. The nozzles, designated generally 74, are in effect stub bolts having a head 76 and a threaded shank 78 by which they may be engaged into selected apertures 72 with the end of the shank substantially flush with, or projecting slightly inwardly of, the inner end of the aperture. A central bore 80 through head 76 and shank 78 provides the nozzle outlet passage. Those openings 72 not provided with nozzles are closed by plugs 82, of the same construction as the nozzles 74 but without the bore 80.

Two nozzles 74 are shown in apertures 72 of the group near the left hand end of the bowl, the other two apertures of the group containing either nozzles 74 or plugs 82. Plugs 82 are shown in two of the other group of four apertures 72 in FIG. 1, the other two containing either nozzles or plugs, as desired. As previously indicated, however, all the apertures 72 may contain nozzles 74 or only one of the apertures may contain a nozzle 74 with the remainder containing plugs 82. The apertures 72 need not be arranged in circumferentially aligned groups as shown and there may be more or less than the number shown.

Figure 2C:
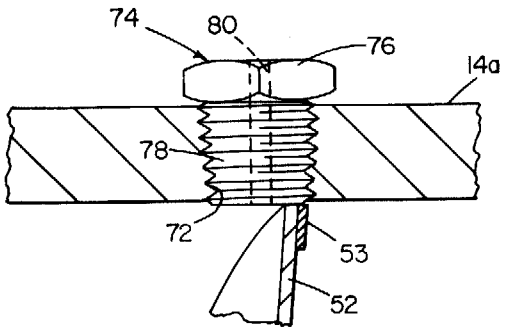
FIG. 2A, 2B and 2C are enlargements of the cross-section indicated at 2—2 of FIG. 1 showing, respectively, three different positions of the conveyor blade relative to the nozzle.
Figure 2B:
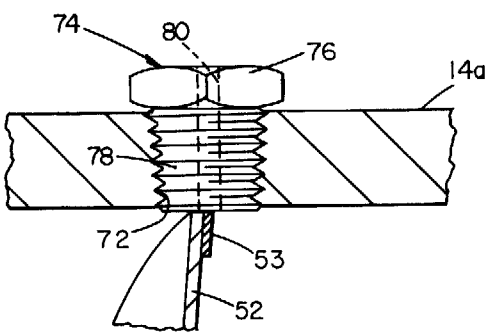
Figure 2A:
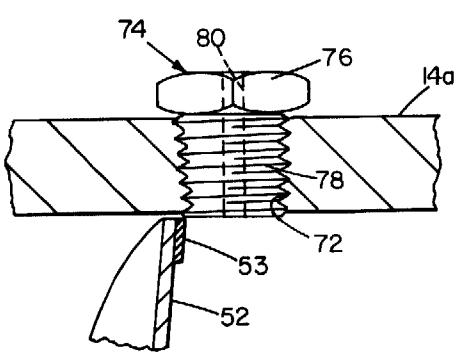

FIGS. 2A, 2B and 2C illustrate the action of the conveyor blade helix relative to each nozzle on each revolution of the conveyor relative to the bowl. As will be seen, the conveyor blade 52 moves across the inner end of the nozzle, from left to right in the drawing and toward the bowl-end outlet for solids, pushing those settled solids ahead of it that do not escape through outlet passage 80. FIG. 2A shows the start of this movement, FIG. 2B an intermediate position and FIG. 2C the end at approximately the relative position of FIG. 1.

In order to collect separately the outputs from nozzles 74, casing base 10 is provided with an opening having a surrounding flange 83 for bolting to a collecting hooper (not shown). While nozzles are located only in the cylindrical bowl portion **14*a*, the bottom opening extends approximately the full length of the bowl to collect also any liquid and/or solids that may escape into the casing surrounding frusto-conical bowl section 14*b*. A central baffle 84 in casing 12 surrounds a ring 86 on the bowl so that collections from the nozzles in bowl section 14*a* may be segregated from those at the other side of baffle 84** into separate hoppers if desired. Further baffling may be provided to segregate collections from nozzles spaced longitudinally of the bowl axis, if desired for sub-classification as previously mentioned.

The nozzle or nozzles nearest the effluent discharge end of the bowl are desirably within 10 inches, preferably about 6 inches, therefrom. For many types of clay and other slurries, a diameter of about ⅛th inch for the nozzle outlet passage is desirable.

I claim:

1. In a solids-liquid separating centrifuge of the type having a bowl with a reduced diameter end outlet for solids, a helically bladed conveyor within the bowl extending substantially from end to end of the bowl and arranged to move solids settling in said bowl toward said end outlet, means for rotating said bowl and conveyor about a common axis to convey a first portion of the solids settling in said bowl to said end outlet, and feed means for discharging slurry into said bowl at a feed point spaced from said end outlet, the improvement comprising:

classifying means for segregating and separately discharging from the bowl a second portion of the slurry solids having mainly characteristics different from the solids principally contained in said first portion such that they are relatively slower in settling and more difficult for said conveyor to convey;

said classifying means including at least one nozzle outlet through the peripheral wall of the bowl having an outlet passage with its inlet exposed to the path of movement of solids by the conveyor, intermediate the ends of the conveyor;

said conveyor having a unidirectional pitch directed toward said bowl end outlet at opposite sides of said nozzle inlet, so that solids settling in said bowl at the side of said nozzle outlet remote from said bowl end outlet are conveyed thereby to said nozzle inlet, solids of said first portion are conveyed thereby across said nozzle inlet and on toward said bowl end outlet, and slurry containing solids of said second solids portion is ejected through said nozzle passage by centrifugal force;

and means for collecting the outputs from said end outlet and said classifying means.

2. A centrifuge according to claim 1 wherein said bowl portion is adjacent the end of the bowl remote from said end outlet.

3. A centrifuge according to claim 1 wherein said classifying means includes a plurality of said nozzle outlets.

4. A centrifuge according to claim 3 wherein at least two of said nozzle outlet passages have their inlets disposed adjacent the end of the bowl remote from said end outlet.

5. A centrifuge according to claim 4 which includes an outlet for effluent in the end of the bowl remote from said end outlet for solids.

6. A centrifuge according to claim 5 wherein said bowl has a cylindrical part and a connecting frusto-conical part the smaller end of which comprises said end outlet, said feed point is adjacent the juncture of said bowl parts, and said nozzle inlets are located in said cylindrical bowl part.

7. A centrifuge according to claim 6 wherein said at least two of said nozzles are spaced within 10 inches from the adjacent end of the bowl.

8. A centrifuge according to any of claims 1 to 7 wherein the diameter of said nozzle outlet passage is about ⅛th inch.

9. A centrifuge according to any of claims 1 to 7 which includes means for discharging wash fluid to the solids in said bowl adjacent said bowl end outlet for solids.

* * * * *